United States Patent [19]

Trokhan

[11] Patent Number: 4,528,239

[45] Date of Patent: Jul. 9, 1985

[54] DEFLECTION MEMBER

[75] Inventor: Paul D. Trokhan, Hamilton, Ohio

[73] Assignee: The Procter & Gamble Company, Cincinnati, Ohio

[21] Appl. No.: 525,585

[22] Filed: Aug. 23, 1983

[51] Int. Cl.[3] ..... B32B 7/00

[52] U.S. Cl. ..... 428/247; 428/131; 428/252; 428/255

[58] Field of Search ..... 430/320; 428/255, 256, 428/260, 265, 131, 137, 247, 252; 427/43.1, 282

[56] References Cited

U.S. PATENT DOCUMENTS

| | | | |
|---|---|---|---|
| 3,322,617 | 5/1967 | Osbourne | 162/296 |
| 3,617,442 | 11/1971 | Hurschman | 162/DIG. 1 |
| 4,070,235 | 1/1978 | Marshall | 162/149 |
| 4,191,609 | 3/1980 | Trokhan | 162/113 |
| 4,239,065 | 12/1980 | Trokhan | 162/DIG. 1 |
| 4,291,116 | 9/1981 | Tibbetts | 430/328 |
| 4,340,057 | 7/1982 | Block et al. | 428/255 |

FOREIGN PATENT DOCUMENTS 41-9125 of 1966 Japan .

*Primary Examiner*—James J. Bell

*Attorney, Agent, or Firm*—Monte D. Witte; Fredrick H. Braun; Richard C. Witte

[57] ABSTRACT

Foraminous members useful in making paper webs. The foraminous member of this invention has a macroscopically monoplanar, patterned, continuous network surface which serves to define within the member a plurality of discrete, isolated, deflection conduits. A foraminous woven element, such as a screen, is thoroughly coated with liquid photosensitive resin to a controlled depth above the upper surface of the woven element. A mask or a negative having opaque and transparent regions which define the pattern is brought into contact with the surface of the liquid photosensitive resin and the resin is exposed to light of an activating wavelength through the mask. The resin exposed to the activating light is hardened (cured). Uncured resin is removed from the composite leaving behind the woven element with the solid network formed by the cured resin.

25 Claims, 10 Drawing Figures

DEFLECTION MEMBER

BACKGROUND OF THE INVENTION

1. Field of the Invention

This invention relates to foraminous members useful in making strong, soft, absorbent paper webs and to the processes for making the foraminous members.

2. Background Art

One pervasive feature of daily life in modern industrialized societies is the use of disposable products, particularly disposable products made of paper. Paper towels, facial tissues, sanitary tissues, and the like are in almost constant use. Naturally, the manufacture of items in such great demand has become, in the Twentieth Century, one of the largest industries in industrially developed countries. The general demand for disposable paper products has, also naturally, created a demand for improved versions of the products and of the methods of their manufacture. Despite great strides in paper making, research and development efforts continue to be aimed at improving both the products and their processes of manufacture.

Disposable products such as paper towels, facial tissues, sanitary tissues, and the like are made from one or more webs of tissue paper. If the products are to perform their intended tasks and to find wide acceptance, they, and the tissue paper webs from which they are made, must exhibit certain physical characteristics. Among the more important of these characteristics are strength, softness, and absorbency.

Strength is the ability of a paper web to retain its physical integrity during use.

Softness is the pleasing tactile sensation the user perceives as he crumples the paper in his hand and contacts various portions of his anatomy with it.

Absorbency is the characteristic of the paper which allows it to take up and retain fluids, particularly water and aqueous solutions and suspensions. Important not only is the absolute quantity of fluid a given amount of paper will hold, but also the rate at which the paper will absorb the fluid. When the paper is formed into a device such as a towel or wipe, the ability of the paper to cause a fluid to preferentially be taken up into the paper and thereby leave a wiped surface dry is also important.

An example of paper webs which have been widely accepted by the consuming public are those made by the process described in U.S. Pat. No. 3,301,746 issued to Sanford and Sisson on Jan. 31, 1967. Other widely accepted paper products are made by the process described in U.S. Pat. No. 3,994,771 issued to Morgan and Rich on Nov. 30, 1976. Despite the high quality of products made by these two processes, the search for still improved products has, as noted above, continued. The present invention is a noteworthy fruit of that search.

SUMMARY OF THE INVENTION

This invention is of an improved foraminous member useful in making an improved paper and of the process by which the foraminous member is made.

The improved paper is characterized as having two regions; one is a network (or open grid) region, the other is a plurality of domes. (The domes appear to be protuberances when viewed from one surface of the paper and cavities when viewed from the opposite surface.) The network is continuous, is macroscopically monoplanar, and forms a preselected pattern. It completely encircles the domes and isolates one dome from another. The domes are dispersed throughout the whole of the network region. The network region has a relatively low basis weight and a relative high density while the domes have relatively high basis weights and relatively low densities. Further, the domes exhibit relatively low intrinsic strength while the network region exhibits relatively high intrinsic strength.

The improved paper exhibits good absorbency, softness, tensile strength, burst strength, bulk (apparent density) and, depending on the preselected pattern of the network region, the ability to stretch in the machine direction, in the cross-machine direction, and in intermediate directions even in the absence of creping. It is useful in the manufacture of numerous products such as paper towels, sanitary tissues, facial tissues, napkins, and the like.

The foraminous member of this invention (which, because of its preferred utility will be hereinafter referred to as a "deflection member") comprises a macroscopically monoplanar, patterned, continuous network surface. The network surface defines within the deflection member a plurality of discrete, isolated, deflection conduits. It is made by a process which comprises the steps of coating a foraminous woven element with liquid photosensitive resin, controlling the thickness of the photosensitive resin to a preselected value, exposing the resin to light having an activating wavelength through a mask having opaque and transparent regions which define the pattern of the network surface, and removing uncured resin from the composite comprising the foraminous woven element and cured resin.

Accordingly, it is an object of this invention to provide a foraminous member useful in making improved paper webs to be used in the manufacture of numerous products used in the home and by business and industry.

Figure 1:
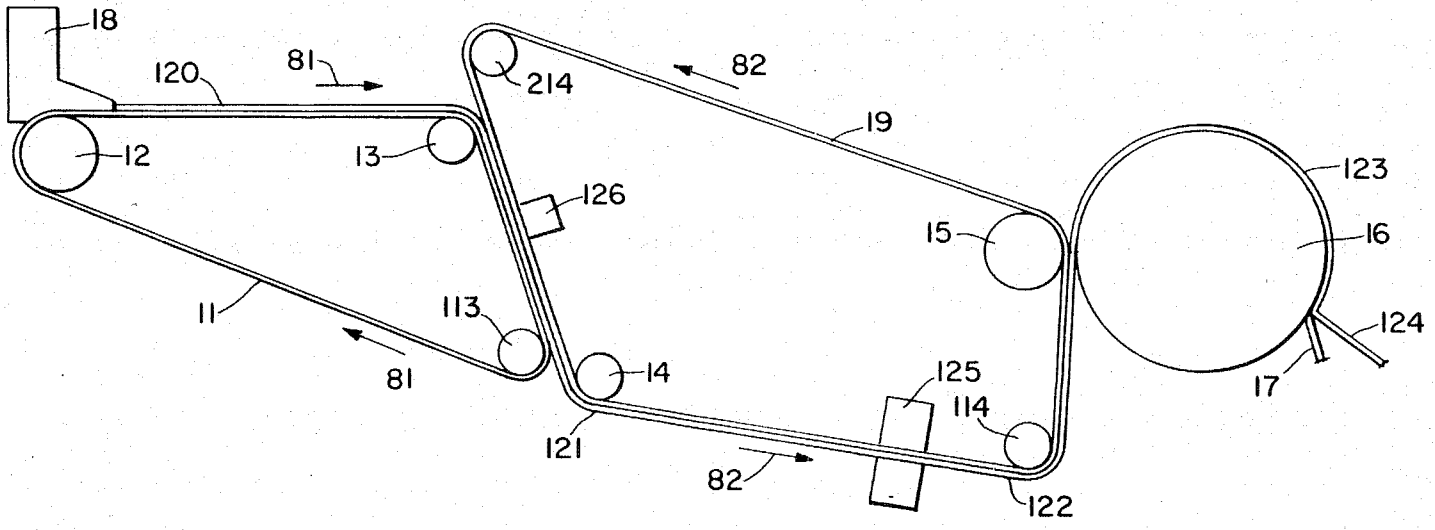
FIG. 1 is a schematic representation of one embodiment of a continuous papermaking machine which uses the foraminous member of this invention.

In the drawings, like features are identically designated.

DETAILED DESCRIPTION OF THE INVENTION

While this specification concludes with claims particularly pointing out and distinctly claiming that which is regarded as the invention, it is believed that the invention can be more readily understood through perusal of the following detailed description of the invention in combination with study of the associated drawings and appended examples.

The papermaking process which uses the deflection member of this invention comprises a number of steps or operations which occur in time sequence as noted below. Each step will be discussed in detail in the following paragraphs.

(a) Providing an aqueous dispersion of papermaking fibers;

(b) Forming an embryonic web of papermaking fibers from the aqueous dispersion on a foraminous surface such as a Fourdinier wire;

(c) Associating the embryonic web with a deflection member which has one surface (the embryonic web-contacting surface) comprising a macroscopically monoplaner network surface which is continuous and patterned and which defines within the deflection member a plurality of discreet, isolated, deflection conduits;

(d) Deflecting the papermaking fibers in the embryonic web into the deflection conduits and removing water from the embryonic web through the deflection conduits so as to form an intermediate web of papermaking fibers under such conditions that the deflection of the papermaking fibers is initiated no later than the time at which the water removal through conduits is initiated;

(e) Drying the intermediate web; and (f) Foreshortening the web.

The first step in the practice of the papermaking process is the providing of an aqueous dispersion of papermaking fibers.

Useful papermaking fibers include those cellulosic fibers commonly known as wood pulp fibers. Fibers derived from soft woods (gymnosperms or coniferous trees) and hard woods (angiosperms or deciduous trees) are contemplated for use in this invention. The particular species of tree from which the fibers are derived is immaterial.

The wood pulp fibers can be produced from the native wood by any convenient pulping process. Chemical processes such as sulfite, sulphate (including the Kraft) and soda processes are suitable. Mechanical processes such as thermomechanical (or Asplund) processes are also suitable. In addition, the various semi-chemical and chemi-mechanical processes can be used. Bleached as well as unbleached fibers are contemplated for use. Preferably, when the paper web of this invention is intended for use in absorbent products such as paper towels, bleached northern softwood Kraft pulp fibers are preferred.

In addition to the various wood pulp fibers, other cellulosic fibers such as cotton linters, rayon, and bagasse can be used in this invention. Synthetic fibers such as polyester and polyolefin fibers can also be used and, in fact, are preferred in certain applications.

Normally, the embryonic web (which is hereinafter defined) is prepared from an aqueous dispersion of the papermaking fibers. While fluids other than water can be used to disperse the fibers prior to their formation into an embryonic web, the use of these other fluids is not preferred for a variety of reasons, not the least of which is the cost of recovering non-aqueous fluids.

Any equipment commonly used in the art for dispersing fibers can be used. The fibers are normally dispersed at a consistency of from about 0.1 to about 0.3% at the time an embryonic web is formed.

(In this specification, the moisture content of various dispersions, webs, and the like is expressed in terms of percent consistency. Percent consistency is defined as 100 times the quotient obtained when the weight of dry fiber in the system under discussion is divided by the total weight of the system. An alternate method of expressing moisture content of a system sometimes used in the papermaking art is pounds of water per pound of fiber or, alternatively and equivalently, kilograms of water per kilogram of fiber. The correlation between the two methods of expressing moisture content can be readily developed. For example, a web having a consistency of 25% comprises 3 kilograms of water per kilogram of fiber; 50%, 1 kilogram of water per kilogram of fiber; and 75%, 0.33 kilogram of water per kilogram of fiber. Fiber weight is always expressed on the basis of bone dry fibers.)

In addition to papermaking fibers, the embryonic web formed during the papermaking process and, typically, the dispersion from which the web is formed can include various additives commonly used in papermaking. Example of useful additives include wet strength agents such as urea-formaldehyde resins, melamine formaldehyde resins, polyamide-epichlorohydrin resins, polyethyleneimine resins, polyacrylamide resins, and dialdehyde starches. Dry strength additives, such as polysalt coacervates rendered water soluble by the inclusion of ionization suppressors are also used herein. Complete descriptions of useful wet strength agents can be found in Tappi Monograph Series No. 29, *Wet Strength in Paper and Paperboard,* Technical Association of Pulp and Paper Industry (New York, 1965), incorporated herein by reference, and in other common references. Dry strength additives are described more fully in U.S. Pat. No. 3,660,338 issued to Economou on May 2, 1972, also incorporated herein by reference, and in other common references. The levels at which these materials are useful in paper webs is also described in the noted references.

Other useful additives include debonders which increase the softness of the paper webs. Specific debonders which can be used in the present invention include quaternary ammonium chlorides such as ditallowdimethyl ammonium chloride and bis (alkoxy-(2-hydroxy)propylene) quaterary ammonium compounds. U.S. Pat. No. 3,554,863 issued to Hervey et al. on Jan 12, 1971 and U.S. Pat. No. 4,144,122 issued to Emanuelsson et al. on Mar. 13, 1979, and U.S. Pat. No. 4,351,699 issued to Osborn, III on Sept. 28, 1982, all incorporated herein by reference, more fully discuss debonders.

In addition, those pigments, dyes, fluorescers, and the like commonly used in paper products can be incorporated in the dispersion.

The second step in the papermaking process is forming an embryonic web of papermaking fibers on a foraminous surface from the aqueous dispersion provided in the first step.

As used in this specification, an embryonic web is that web of fibers which is, during the course of the papermaking process, subjected to rearrangement on the deflection member of this invention as hereinafter described. As more fully discussed hereinafter, the embryonic web is formed from the aqueous dispersion of papermaking fibers by depositing that dispersion onto a foraminous surface and removing a portion of the aqueous dispersing medium. The fibers in the embryonic web normally have a relatively large quantity of water associated with them; consistencies in the range of from about 5% to about 25% are common. Normally, an embryonic web is too weak to be capable of existing without the support of an extraneous element such as a Fourdrinier wire. Regardless of the technique by which an embryonic web is formed, at the time it is subjected to rearrangement on the deflection member it must be held together by bonds weak enough to permit rearrangement of the fibers under the action of the forces hereinafter described.

As noted, the second step in the papermaking process is the forming of an embryonic web. Any of the numerous techniques well known to those skilled in the papermaking art can be used in the practice of this step. The precise method by which the embryonic web is formed is immaterial to the practice of this invention so long as the embryonic web possesses the characteristics discussed above. As a practical matter, continuous papermaking processes are preferred, even though batch process, such as handsheet making processes, can be used. Processes which lend themselves to the practice of this step are described in many references such as U.S. Pat. No. 3,301,746 issued to Sanford and Sisson on Jan. 31, 1974, and U.S. Pat. No. 3,994,771 issued to Morgan and Rich on Nov. 30, 1976, both incorporated herein by reference.

FIG. 1 is a simplified, schematic representation of one embodiment of a continuous papermaking machine useful in the practice of the papermaking process.

An aqueous dispersion of papermaking fibers as hereinbefore described is prepared in equipment not shown and is provided to headbox 18 which can be of any convenient design. From headbox 18 the aqueous dispersion of papermaking fibers is delivered to a foraminous surface which is sometimes called first foraminous member 11 and which is typically a Fourdrinier wire.

First foraminous member 11 is supported by breast roll 12 and a plurality of return rolls of which only two, 13 and 113, are illustrated. First foraminous member 11 is propelled in the direction indicated by directional arrow 81 by drive means not shown. Optional auxiliary units and devices commonly associated papermaking machines and with first foraminous member 11, but not shown in FIG. 1, include forming boards, hydrofoils, vacuum boxes, tension rolls, support rolls, wire cleaning showers, and the like.

The purpose of headbox 18 and first foraminous member 11, and the various auxiliary units and devices, illustrated and not illustrated, is to form an embryonic web of papermaking fibers.

After the aqueous dispersion of papermaking fibers is deposited onto first foraminous member 11, embryonic web 120 is formed by removal of a portion of the aqueous dispersing medium by techniques well known to those skilled in the art. Vacuum boxes, forming boards, hydrofoils, and the like are useful in effecting water removal. Embryonic web 120 travels with first foraminous member 11 about return roll 13 and is brought into the proximity of a second foraminous member which has the characteristics described below.

The third step in the papermaking process is associating the embryonic web with the second foraminous member which is sometimes referred to as the "deflection member" and which is the foraminous or deflection member of this invention. The purpose of this third step is to bring the embryonic web into contact with the deflection member on which it will be subsequently deflected, rearranged, and further dewatered.

In the embodiment illustrated in FIG. 1, the deflection member takes the form of an endless belt, deflection member 19. In this simplified representation, deflection member 19 passes around and about deflection member return rolls 14, 114, and 214 and impression nip roll 15 and travels in the direction indicated by directional arrow 82. Associated with deflection member 19, but not shown in FIG. 1, are various support rolls, return rolls, cleaning means, drive means, and the like commonly used in papermaking machines and all well known to those skilled in the art.

Regardless of the physical form which the deflection member takes, whether it be an endless belt as just discussed or some other embodiment such as a stationary plate for use in making handsheets or a rotating drum for use with other types of continuous processes, it must have certain physical characteristics.

First, the deflection member must be foraminous. That is to say, it must possess continuous passages connecting its first surface (or "upper surface" or "working surface"; i.e. the surface with which the embryonic web is associated, sometimes referred to as the "embryonic web-contacting surface") with its second surface (or "lower surface"). Stated in another way, the deflection member must be constructed in such a manner that when water is caused to be removed from the embryonic web, as by the application of differential fluid pressure, and when the water is removed from the embyonic web in the direction of the foraminous member, the water can be discharged from the system without having to again contact the embryonic web in either the liquid or the vapor state.

Second, the embryonic web-contacting surface of the deflection member must comprise a macroscopically monoplanar, patterned, continuous network surface. This network surface must define within the deflection member a plurality of discrete, isolated, deflection conduits.

The network surface has been described as being "macroscopically monoplanar." As indicated above, the deflection member may take a variety of configurations such as belts, drums, flat plates, and the like. When a portion of the embryonic web-contacting surface of the deflection member is placed into a planar configuration, the network surface is essentially monoplanar. It is said to be "essentially" monoplanar to recognize the fact that deviations from absolute planarity are tolerable, but not preferred, so long as the deviations are not substantial enough to adversely affect the performance of the product formed on the deflection member. The network surface is said to be "continuous" because the lines formed by the network surface must form at least one essentially unbroken net-like pattern. The pattern is said to be "essentially" continuous to recognize the fact that interruptions in the pattern are tolerable, but not preferred, so long as the interruptions are not substantial enough to adversely affect the performance of the product made on the deflection member.

Figure 2:
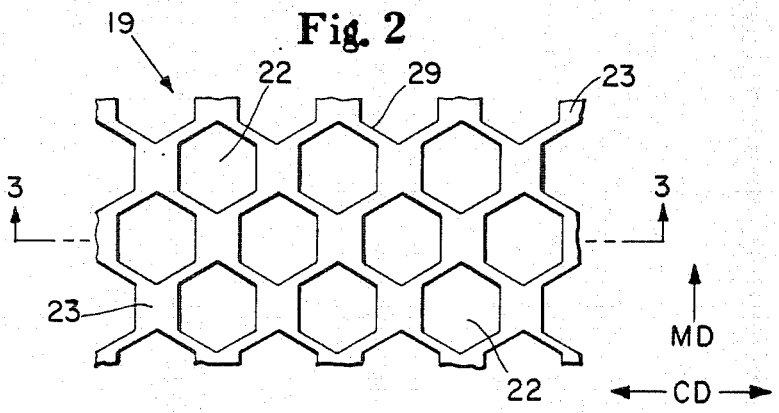
FIG. 2 is a plan view of a portion of a foraminous member.

FIG. 2 is a simplified representation of a portion of deflection member 19. In this plan view, macroscopically monoplanar, patterned, continuous network surface 23 (for convenience, usually referred to as "network surface 23") is illustrated. Network surface 23 is shown in define deflection conduits 22. In this simplified representation, network surface 23 defines deflection conduits 22 in the form of hexagons in bilaterally staggered array. It is to be understood that network surface 23 can be provided with a variety of patterns having various shapes, sizes, and orientations as will be more fully discussed hereinafter. Deflection conduits 22 will, then, also take on a variety of configurations.

Figure 3:
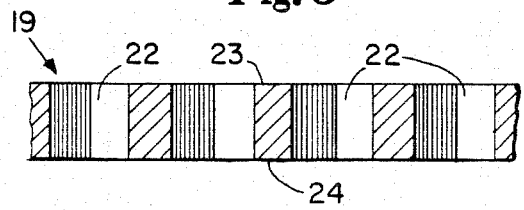
FIG. 3 is a cross sectional view of a portion of the foraminous member shown in FIG. 2 as taken along line 3—3.

FIG. 3 is a cross sectional view of that portion of deflection member 19 shown in FIG. 2 as taken along line 3—3 of FIG. 2. FIG. 3 clearly illustrates the fact that deflection member 19 is foraminous in that deflection conduits 22 extend through the entire thickness of deflection member 19 and provide the necessary continuous passages connecting its two surfaces as mentioned above. Deflection member 19 is shown to have a bottom surface 24.

As illustrated in FIGS. 2 and 3, deflection conduits 22 are shown to be discrete. That is, they have a finite shape that depends on the pattern selected for network surface 23 and are separated one from another. Stated in still other words, deflection conduits 22 are discretely perimetrically enclosed by network surface 23. This separation is particularly evident in the plan view. They are also shown to be isolated in that there is no connection within the body of the deflection member between one deflection conduit and another. This isolation one from another is particularly evident in the cross-section view. Thus, transfer of material from one deflection conduit to another is not possible unless the transfer is effected outside the body of the deflection member.

An infinite variety of geometries for the network surface and the openings of the deflection conduits are possible. The following discussion is concerned entirely with the geometry of the network surface (i.e. 23) and the geometry of the openings (i.e. 29) of the deflection conduits in the plane of the network surface.

First, it must be recognized that the surface of the deflection member comprises two distinct regions: the network surface 23 and the openings 29 of the deflection conduits. Selection of the parameters describing one region will necessarily establish the parameters of the other region. That is to say, since the network surface defines within it the deflection conduits, the specification of the relative directions, orientations, and widths of each element or branch of the network surface will of necessity define the geometry and distribution of the openings of the deflection conduits. Conversely, specification of the geometry and distribution of the openings of the deflection conduits will of necessity define the relative directions, orientations, widths, etc. of each branch of the network surface.

For convenience, the surface of the deflection member will be discussed in terms of the geometry and distribution of the openings of the deflection conduits. (As a matter of strict accuracy, the openings of the deflection conduits in the surface of the deflection member are, naturally, voids. While there may be certain philosophical problems inherent in discussing the geometry of nothingness, as a practical matter those skilled in the art can readily understand and accept the concept of an opening—a hole, as it were—having a size and a shape and a distribution relative to other openings.)

While the openings of the deflection conduit can be of random shape and in random distribution, they preferably are uniform shape and are distributed in a repeating, preselected pattern.

Practical shapes include circles, ovals, and polygons of six or fewer sides. There is no requirement that the openings of the deflection conduits be regular polygons or that the sides of the openings be straight; openings with curved sides, such as trilobal figures, can be used. Especially preferred is the nonregular six-sided polygon illustrated in FIG. 10.

Figure 10:
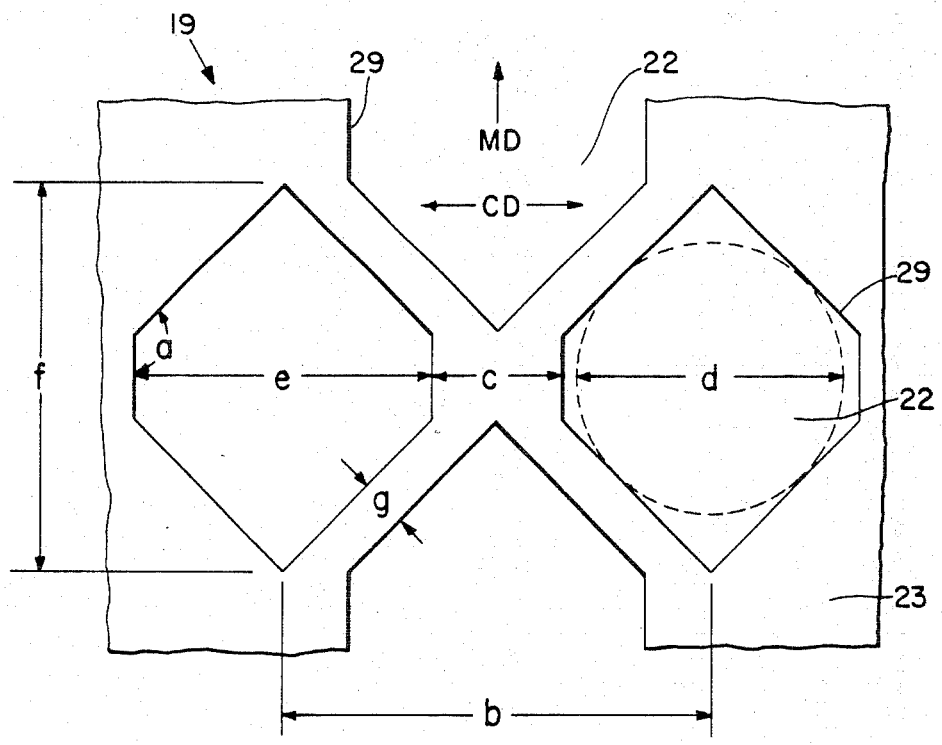
FIG. 10 is a schematic representation of a preferred deflection conduit opening geometry.

FIG. 10 is a schematic representation of an especially preferred geometry of the openings of the deflection conduits (and, naturally, of the network surface). Only a portion of simple deflection member 19 showing a repeating pattern (unit cell) is shown. Deflection conduits 22 having openings 29 are separated by network surface 23. Openings 29 are in the form of nonregular six-sided figures. Reference letter "a" represents the angle between the two sides of an opening as illustrated, "f" the point-to-point height of an opening, "c" the CD spacing between adjacent openings, "d" the diameter of the largest circle which can be inscribed in an opening, "e" the width between flats of an opening, "g" the spacing between two adjacent openings in a direction intermediate MD and CD, and "b" the shortest distance (in either MD or CD) between the centerlines of two MD or CD adjacent openings. In an especially preferred embodiment, for use with northern softwood Kraft furnishes, "a" is 135°, "c" is 0.56 millimeter (0.022 inch), "e" is 1.27 mm (0.050 in.), "f" is 1.62 mm (0.064 in.), "g" is 0.20 mm (0.008 in.) and the ratio of "d" to "b" is 0.63. A deflection member constructed to this geometry has an open area of about 69%. These dimensions can be varied proportionally for use with other furnishes.

A preferred spacing is a regular, repeating distribution of the openings of the deflection conduits such as regularly and evenly spaced openings in aligned ranks and files. Also preferred are openings regularly spaced in regulary spaced ranks wherein the openings in adjacent ranks are offset one from another. Especially preferred is a bilaterally staggered array of openings as illustrated in FIG. 2. It can be seen that the deflection conduits are sufficiently closely spaced that the machine direction (MD) span (or length) of the opening 29 of any deflection conduit (the reference opening) completely spans the MD space intermediate a longitudinally (MD) spaced pair of openings which latter pair is disposed laterally adjacent the reference opening. Further, the deflection conduits are also sufficiently closely spaced that the cross machine direction (CD) span (or width) of the opening 29 of any deflection conduit (the reference opening) completely spans the CD space intermediate a laterally (CD) spaced pair of openings which latter pair is disposed longitudinally adjacent the reference opening. Stated in perhaps simpler terms, the openings of the deflection conduits are of sufficient size and spacing that, in any direction, the edges of the openings extend past one another.

In papermaking, directions are normally stated relative to machine direction (MD) or cross machine direction (CD). Machine direction refers to that direction which is parallel to the flow of the web through the equipment. Cross machine direction is perpendicular to the machine direction. These directions are indicated in FIGS. 2, 4 and 10.

Figure 4:
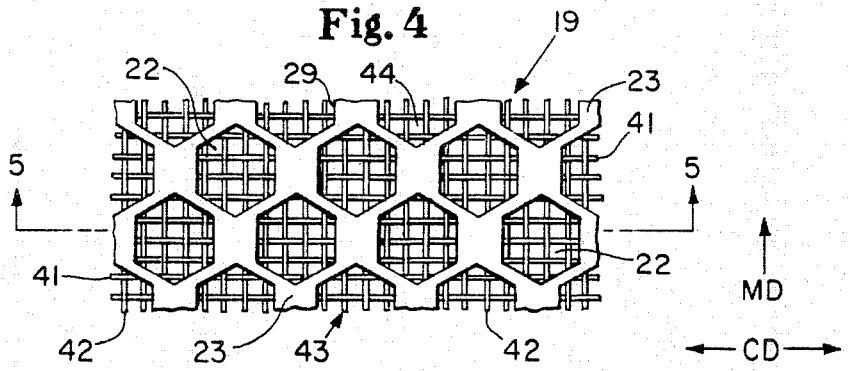
FIG. 4 is a plan view of an alternate embodiment of a foraminous member.
Figure 5:
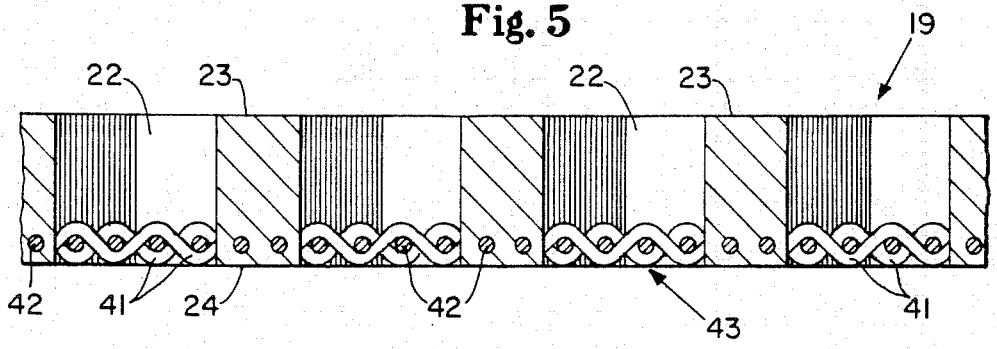
FIG. 5 is a cross sectional view of a portion of the foraminous member shown in FIG. 4 as taken along line 5—5.

FIGS. 4 and 5 are analogous to FIGS. 2 and 3, but illustrate a more practical, and preferred, deflection member. FIG. 4 illustrates in plan view a portion of deflection member 19. Network surface 23 is the upper surface of a framework and defines openings 29 of the deflection conduits as hexagons in bilaterally staggered array, but it is to be understood that, as before, a variety of shapes and orientations can be used. FIG. 5 illustrates a cross sectional view of that portion of deflection member 19 shown in FIG. 4 as taken along line 5—5. Machine direction reinforcing strands 42 and cross direction reinforcing strands 41 are shown in both FIGS. 4 and 5. Together machine direction reinforcing strands 42 and cross direction reinforcing strands 41 combine to form foraminous woven element 43. One purpose of the reinforcing strands is to strengthen the deflection member. As shown, reinforcing strands 41 and 42 are round and are provided as a square weave fabric around which the deflection member has been constructed. Any convenient filament size in any convenient weave can be used so long as flow through the deflection conduits is not significantly hampered during web processing and so long as the integrity of the deflection member as a whole is maintained. The material of construction is immaterial; polyester is preferred.

An examination of the preferred type of deflection member illustrated in FIG. 4 will reveal that there are actually two distinct types of openings (or foramina) in the deflection member. The first is the opening 29 of the deflection conduit 22 the geometry of which was discussed immediately above; the second type comprises the interstices between strands 41 and 42 in woven foraminous element 43. These latter openings are referred to as fine foramina 44. To emphasize the distinction, the openings 29 of the deflection conduits 22 are sometimes referred to as gross foramina.

Thus far, little has been written about the geometry of the network surface per se. It is readily apparent, especially from an examination of FIG. 2, that the network surface will comprise a series of intersecting lines of various lengths, orientations, and widths all dependent on the particular geometry and distribution selected for the openings 29 of the deflection conduits. It is to be understood that it is the combination and interrelation of the two geometries which influence the properties of the paper web of this invention. It is also to be understood that interactions between various fiber parameters (including length, shape, and orientation in the embryonic web) and network surface and deflection conduit geometrics influence the properties of the paper web.

As mentioned above, there an infinite variety of possible geometries for the network surface and the openings of the deflection conduits. Certain broad guidelines for selecting a particular geometry can be stated. First, regularly shaped and regulary organized gross foramina are important in controlling the physical properties of the final paper web. The more random the organization and the more complex the geometry of the gross foramina, the greater is their effect on the appearance attributes of a web. The maximum possible staggering of the gross foramina tends to produce isotropic paper webs. If anisotropic paper webs are desired, the degree of staggering of the gross foramina should be reduced.

Second, for most purposes, the open area of the deflection member (as measured solely by the open area of the gross foramina) should be from about 35% to about 85%. The actual dimensions of the gross foramina (in the plane of the surface of the deflection member) can be expressed in terms of effective free span. Effective free span is defined as the area of the opening of the deflection conduit in the plane of the surface of the deflection member (i.e. the area of a gross foramen) divided by one-fourth of the perimeter of the gross foramen. Effective free span, for most purposes, should be from about 0.25 to about 3.0 times the average length of the papermaking fibers used in the process, preferably from about 0.35 to about 2.0 times the fiber length.

In order to form paper webs having the greatest possible strength, it is desirable that localized stresses within the web be minimized. The relative geometries of the network surface and the gross foramina have an effect on this minimization. For simple geometries (such as circles, triangles, hexagons, etc.) the ratio of the diameter of the largest circle which can be inscribed within the gross foramina ("d") to the shortest distance (in either MD or CD) between central lines of neighboring gross foramina ("b") should be between about 0.45 and about 0.95.

The third fact to be considered is the relative orientation of the fibers in the embryonic web, the overall direction of the geometries of the network surfaces and the gross foramina, and the type and direction of foreshortening (as the latter is hereinafter discussed). Since the fibers in the embryonic web generally possess a distinct orientation, (which can depend on the operating parameters of the system used to form the embryonic web) the interaction of this fiber orientation with the orientation of the network surface geometry will have an effect on web properties. In the usual foreshortening operation, i.e. during creping, the doctor blade is oriented in the cross machine direction. Thus the orientation of the geometries of the network surface and the gross foramina relative to the doctor blade strongly influence the nature of the crepe and, hence, the nature of the paper web.

As discussed thus far, the network surface and deflection conduits have single coherent geometries. Two or more geometries can be superimposed one on the other to create webs having different physical and aesthetic properties. For example, the deflection member can comprise first deflection conduits having openings described by a certain shape in a certain pattern and defining a monoplanar first network surface all as discussed above. A second network surface can be superimposed on the first. This second network surface can be coplanar with the first and can itself define second conduits of such a size as to include within their ambit one or more whole or fractional first conduits. Alternatively, the second network surface can be noncoplanar with the first. In further variations, the second network surface can itself be nonplanar. In still further variations, the second (the superimposed) network surface can merely describe open or closed figures and not actually be a network at all; it can, in this instance, be either coplanar or noncoplanar with the first network surface. It is expected that these latter variations (in which the second network surface does not actually form a network) will be most useful in providing aesthetic character to the paper web. As before, an infinite number of geometries and combinations of geometries are possible.

As indicated above, deflection member 19 can take a variety of forms. While the method of construction of the deflection member is immaterial so long as it has the characteristics mentioned above, the following method has been discovered to be useful.

A preferred form of the deflection member is an endless belt which can be constructed by a method adapted from techniques used to make stencil screens. By "adapted" it is meant that the broad, overall techniques of making stencil screens are used, but improvements, refinements, and modifications as discussed below are used to make member having significantly greater thickness than the usual stencil screen.

Broadly, a foraminous element (such as foraminous woven element 43 in FIGS. 4 and 5) is thoroughly coated with a liquid photosensitive polymeric resin to a preselected thickness. A mask or negative incorporating the pattern of the preselected network surface is juxtaposed the liquid photosensitive resin; the resin is then exposed to light of an appropriate wave length through the mask. This exposure to light causes curing of the resin in the exposed areas. Unexposed (and uncured) resin is removed from the system leaving behind the cured resin forming the network surface defining within it a plurality of discreet, isolated deflection conduits. The network surface is, properly, the upper surface of a solid, polymeric framework.

More particularly, the deflection member can be prepared using as the foraminous woven element a belt of width and length suitable for use on the chosen papermaking machine. The network surface and the deflection conduits are formed on this woven belt in a series of sections of convenient dimensions in a batchwise manner, i.e. one section at a time.

First, a planar forming table is supplied. This forming table preferably is at least as wide as the width of the foraminous woven element and is of any convenient length. It is, preferably, provided with means for securing a backing film smoothly and tightly to its surface. Suitable means include provision for the application of vacuum through the surface of the forming table, such as a plurality of closely spaced orifices and tensioning means.

A relatively thin, flexible, preferably polymeric (such as polypropylene) backing film is placed on the forming table and is secured thereto, as by the application of vacuum or the use of tension. The backing film serves to protect the surface of the forming table and to provide a smooth surface from which the cured photosensitive resins will, later, be readily released. This backing film will form no part of the completed deflection member.

Preferably, either the backing film is of a color which absorbs activating light or the backing film is at least semi-transparent and the surface of the forming table absorbs activating light.

A thin film of adhesive, such as 8091 Crown Spray Heavy Duty Adhesive made by Crown Industrial Products Co. of Hebron, Ill., is applied to the exposed surface of the backing film or, alternatively, to the knuckles of the foraminous woven element. A section of the woven foraminous element is then placed in contact with the backing film where it is held in place by the adhesive. Preferably, the woven foraminous element is under tension at the time it is adhered to the backing film.

Next, the woven foraminous element is coated with liquid photosensitive resin. As used herein, "coated" means that the liquid photosensitive resin is applied to the woven foraminous element where it is carefully worked and manipulated to insure that all the openings in the woven foraminous element are filled with resin and that all of the filaments comprising the woven foraminous element are enclosed with the resin as completely as possible. Since the knuckles of the woven foraminous element are in contact with the backing film in the preferred arrangement, it will not be possible to completely encase the whole of each filament with photosensitive resin. Sufficient additional liquid photosensitive resin is applied to the woven foraminous member to form a deflection member having a certain preselected thickness. Preferably, the deflection member is from about 0.35 mm (0.014 in.) to about 3.0 mm (0.150 in.) in overall thickness and the network surface is spaced from about 0.10 mm (0.004 in.) to about 2.54 mm (0.100 in.) from the mean upper surface of the knuckles of the foraminous woven element. Any technique well known to those skilled in the art can be used to control the thickness of the liquid photosensitive resin coating. For example, shims of the appropriate thickness can be provided on either side of the section of deflection member under construction; an excess quantity of liquid photosensitive resin can be applied to the woven foraminous element between the shims; a straight edge resting on the shims and can then be drawn across the surface of the liquid photosensitive resin thereby removing excess material and forming a coating of a uniform thickness.

Suitable photosensitive resins can be readily selected from the many available commercially. They are materials, usually polymers, which cure or cross-link under the influence of activating radiation, usually ultraviolet (UV) light. References containing more information about liquid photosensitive resins include Green et al, "Photocross-linkable Resin System," J. Macro. Sci-Revs. Macro. Chem, C21(2), 187–273 (1981–82); Boyer, "A Review of Ultraviolet Curing Technology," Tappi Paper Synthetics Conf. Proc., Sept. 25–27, 1978, pp 167–172; and Schmidle, "Ultraviolet Curable Flexible Coatings," J. of Coated Fabrics, 8, 10–20 (July, 1978). All the preceeding three references are incorporated herein by reference. An especially preferred liquid photosensitive resin can be selected from the Merigraph series of resins made by Hercules Incorporated of Wilmington, Del.

Once the proper quantity (and thickness) of liquid photosensitive resin is coated on the woven foraminous element, a cover film is optionally and preferably applied to the exposed surface of the resin. The cover film, which must be transparent to light of activating wave length, serves primarily to protect the mask from direct contact with the resin.

A mask (or negative) is placed directly on the optional cover film or on the surface of the resin. This mask is formed of any suitable material which can be used to shield or shade certain portions of the liquid photosensitive resin from light while allowing the light to reach other portions of the resin. The design or geometry preselected for the network region is, of course, reproduced in this mask in regions which allow the transmission of light while the geometries preselected for the gross foramina are in regions which are opaque to light.

Preferably, a rigid member such as a glass cover plate is placed atop the mask and serves to aid in maintaining the upper surface of the photosensitive liquid resin in a planar configuration.

The liquid photosensitive resin is then exposed to light of the appropriate wave length through the cover glass, the mask, and the cover film in such a manner as to initiate the curing of the liquid photosensitive resin in the exposed areas. It is important to note that when the described procedure is followed, resin which would normally be in a shadow cast by a filament, which is usually opaque to activating light, is cured. Curing this particular small mass of resin aids in making the bottom side of the deflection member planar and in isolating one deflection conduit from another.

After exposure, the cover plate, the mask, and the cover film are removed from the system. The resin is sufficiently cured in the exposed areas to allow the woven foraminous element along with the resin to be stripped from the backing film.

Uncured resin is removed from the woven foraminous element by any convenient means such as vacuum removal and aqueous washing.

A section of the deflection member is now essentially in final form. Depending upon the nature of the photosensitive resin and the nature and amount of the radiation previously supplied to it, the remaining, at least partially cured, photosensitive resin can be subjected to further radiation in a post curing operation as required.

The backing film is stripped from the forming table and the process is repeated with another section of the woven foraminous element. Conveniently, the woven foraminous element is divided off into sections of essentially equal and convenient lengths which are numbered serially along its length. Odd numbered sections are sequentially processed to form sections of the deflection member and then even numbered sections are sequentially processed until the entire belt possesses the characteristics required of the deflection member. Preferably, the foraminous woven element is maintained under tension at all times.

In the method of construction just described, the knuckles of the foraminous woven element actually form a portion of the bottom surface of the deflection member. In other, but less preferred embodiments, the foraminous woven element can be physically spaced from the bottom surface.

Multiple replications of the above described technique can be used to construct deflection members having the more complex geometries described above.

The fourth step in the papermaking process is deflecting the fibers in the embryonic web into the deflection conduits and removing water from the embryonic web, as by the application of differential fluid pressure to the embryonic web, to form an intermediate web of papermaking fibers. The deflecting is to be effected under such conditions that there is essentially no water removal from the embryonic web through the deflection conduits after the embryonic web has been associated with the deflection member prior to the deflecting of the fibers into the deflection conduits.

Figure 6:
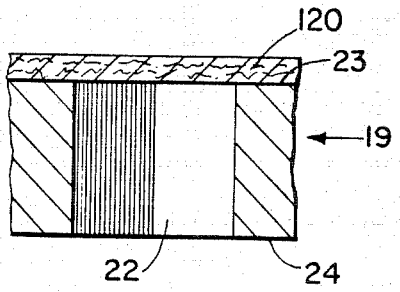
FIG. 6 is a simplified representation in cross section of a portion of an embryonic web in contact with a foraminous member.
Figure 7:
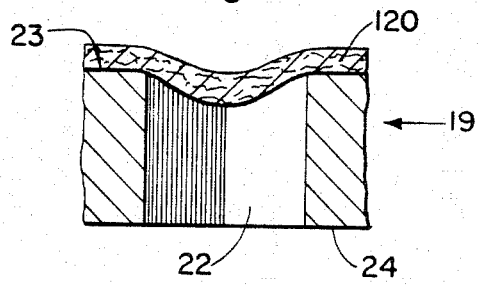
FIG. 7 is a simplified representation of a portion of an embryonic web in contact with a foraminous member after the fibers of the embyonic web have been deflected into a deflection conduit of the foraminous member.

Deflection of the fibers into the deflection conduits is illustrated in FIGS. 6 and 7. FIG. 6 is a simplified representation of a cross section of a portion of deflection member 19 and embryonic web 120 after embryonic web 120 has been associated with deflection member 19, but before the deflection of the fibers into deflection conduits 22 as by the application thereto of differential fluid pressure. In FIG. 6, only one deflection conduit 22 is shown; the embryonic web is associated with network surface 23.

FIG. 7, as FIG. 6, is a simplified cross sectional view of a portion of deflection member 19. This view, however, illustrates embryonic web 120 after its fibers have been deflected into deflection conduit 22 as by the application of differential fluid pressure. It is to be observed that a substantial portion of the fibers in embryonic web 120 and, thus, embryonic web 120 itself, has been displaced below network surface 23 and into deflection conduit 22. Rearrangement of the fibers in embryonic web 120 (not shown) occurs during deflection and water is removed through deflection conduit 22 as discussed more fully hereinafter.

Deflection of the fibers in embryonic web 120 into deflection conduits 22 is induced by, for example, the application of differential fluid pressure to the embryonic web. One preferred method of applying differential fluid pressure is by exposing the embryonic web to a vacuum in such a way that the web is exposed to the vacuum through deflection conduit 22 as by application of a vacuum to deflection member 19 on the side designated bottom surface 24.

In FIG. 1, this preferred method is illustrated by the use of vacuum box 126. Optionally, positive pressure in the form of air or steam pressure can be applied to embryonic web 120 in the vicinity of vacuum box 126 through first foraminous member 11. Means for optional pressure application are not shown in FIG. 1.

It must be noted that either at the time the fibers are deflected into the deflection conduits or after such deflection, water removal from the embryonic web and through the deflection conduits begins. Water removal occurs, for example, under the action of differential fluid pressure. In the machine illustrated in FIG. 1, water removal initially occurs at vacuum box 126. Since deflection conduits 22 are open through the thickness of deflection member 19, water withdrawn from the embryonic web passes through the deflection conduits and out of the system as, for example, under the influence of the vacuum applied to bottom surface 24 of deflection member 19. Water removal continues until the consistency of the web associated with conduit member 19 is increased to from about 25% to about 35%.

Embryonic web 120 has then been transformed into intermediate web 121.

It must be noted that the deflecting must be effected under such conditions that there is essentially no water removal from the embryonic web after its association with the deflection member and prior to the deflection of the fibers into the deflection conduits. As an aid in achieving this condition, deflection conduits 22 are isolated one from another. This isolation, or compartmentalization, of deflection conduits 22 is of importance to insure that the force causing the deflection, such as an applied vacuum, is applied relatively suddenly and in sufficient amount to cause deflection of the fibers rather than gradually, as by encroachment from adjacent conduits, so as to remove water without deflecting fibers.

In the illustrations, the opening of deflection conduit 22 in top surface 23 and its opening in bottom surface 24 are shown essentially equal in size and shape. There is no requirement that the openings in the two planes be essentially identical in size and shape. Inequalities are acceptable so long as each deflection conduit 22 is isolated from each adjacent deflection conduit 22; in fact, circumstances where unequal openings are preferred can be selected. For example, a sharp decrease in the size of a deflection conduit could be useful in forming an interior shelf or ledge which will control the extent of fiber deflection within the deflection conduit. (In other embodiments, this same type of deflection control can be provided by the woven foraminous element included within the deflection member.)

Further, when the deflection member is a belt, the reverse side of deflection member 19 is provided with bottom surface 24 which is preferably planar. This planar surface tends to contact the means for application of differential fluid pressure (vacuum box 126, for example) in such a way that there is a relatively sudden application of differential fluid pressure within each deflection compartment for the reasons noted above.

The fifth step in the papermaking process is the drying of the intermediate web to form the paper web of this invention.

Any convenient means conventionally known in the papermaking art can be used to dry the intermediate web. For example, flow-through dryers and Yankee dryers, alone and in combination, are satisfactory.

A preferred method of drying the intermediate web is illustrated in FIG. 1. After leaving the vicinity of vacuum box 126, intermediate web 121, which is associated with the deflection member 19, passes around deflection member return roll 14 and travels in the direction indicated by directional arrow 82. Intermediate web 121 first passes through optional predryer 125. This predryer can be a conventional flow-through dryer (hot air dryer) well known to those skilled in the art.

The quantity of water removed in predryer 125 is controlled so that predried web 122 exiting predryer 125 has a consistency of from about 30% to about 98%. Predried web 122, which is still associated with deflection member 19, passes around deflection member return roll 114 and travels to the region of impression nip roll 15.

As predried web 122 passes through the nip formed between impression nip roll 15 and Yankee drier drum 16, the network pattern formed by top surface plane 23 of deflection member 19 is impressed into predried web 122 to form imprinted web 123. Imprinted web 123 is then adhered to the surface of Yankee dryer drum 16 where it is dried to a consistency of at least about 95%.

The sixth step in the papermaking process is the foreshortening of the dried web. This sixth step is an optional, but highly preferred, step.

As used herein, foreshortening refers to the reduction in length of a dry paper web which occurs when energy is applied to the dry web in such a way that the length of the web is reduced and the fibers in the web are rearranged with an accompanying disruption of fiber-fiber bonds. Foreshortening can be accomplished in any of several well-known ways. The most common, and preferred, method is creping.

In the creping operation, the dried web is adhered to a surface and then removed from that surface with a doctor blade. Usually, the surface to which the web is adhered also functions as a drying surface and is typically the surface of a Yankee dryer. Such an arrangement is illustrated in FIG. 1.

As mentioned above, predried web 122 passes through the nip formed between impression nip roll 15 and Yankee dryer drum 16. At this point, the network pattern formed by top surface plane 23 of deflection member 19 is impressed into predried web 122 to form imprinted web 123. Imprinted web 123 is adhered to the surface of Yankee dryer drum 16.

The adherence of imprinted web 123 to the surface of Yankee dryer drum 16 is facilitated by the use of a creping adhesive. Typical creping adhesives include those based on polyvinyl alcohol. Specific examples of suitable adhesives are shown in U.S. Pat. No. 3,926,716 issued to Bates on Dec. 16, 1975, incorporated by reference herein. The adhesive is applied to either predried web 122 immediately prior to its passage through the hereinbefore described nip or to the surface of Yankee dryer drum 16 prior to the point at which the web is pressed against the surface of Yankee dryer drum 16 by impression nip roll 15. (Neither means of glue application is indicated in FIG. 1; any technique, such as spraying, well-known to those skilled in the art can be used.) In general, only the nondeflected portions of the web which have been associated with top surface plane 23 of deflection member 19 are directly adhered to the surface of Yankee dryer drum 16. The paper web adhered to the surface of Yankee drum 16 is dried to at least about 95% consistency and is removed (i.e. creped) from that surface by doctor blade 17. Energy is thus applied to the web and the web is foreshortened. The exact pattern of the network surface and its orientation relative to the doctor blade will in major part dictate the extent and the character of the creping imparted to the web.

Paper web 124, which is the product of this invention, can be optionally calendered and is either rewound (with or without differential speed rewinding) or is cut and stacked all by means not illustrated in FIG. 1. Paper web 124 is, then, ready for use.

The improved paper web, which is sometimes known to the trade as a tissue paper web, is made by the process described above. It is characterized as having two distinct regions.

The first is a network region which is continuous, macroscopically monoplanar, and which forms a preselected pattern. It is called a "network region" because it comprises a system of lines of essentially uniform phyical characteristics which intersect, interlace, and cross like the fabric of a net. It is described as "continuous" because the lines of the network region are essentially uninterrupted across the surface of the web. (Naturally, because of its very nature paper is never completely uniform, e.g., on a microscopic scale. The lines of essentially uniform characteristics are uniform in a practical sense and, likewise, uninterrupted in a practical sense.) The network region is described as "macroscopically monoplanar" because, when the web as a whole is placed in a planar configuration, the top surface (i.e. the surface lying on the same side of the paper web as the protrusions of the domes) of the network is essentially planar. (The preceding comments about microscopic deviations from uniformity within a paper web apply here as well as above.) The network region is described as forming a preselected pattern because the lines define (or outline) a specific shape (or shapes) in a repeating (as opposed to random) pattern.

Figure 8:
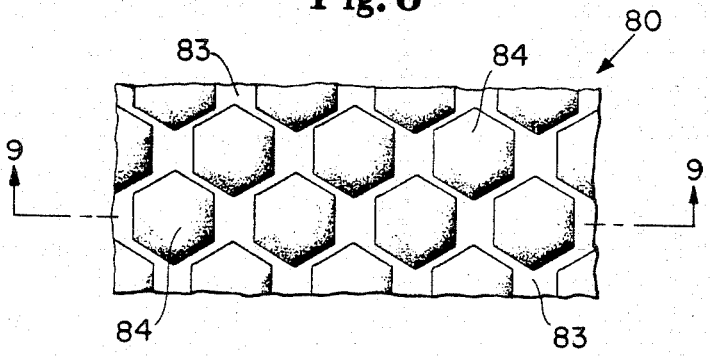
FIG. 8 is a simplified plan view of a portion of a paper web made with the foraminous member of this invention.

FIG. 8 illustrates in plan view a portion of an improved paper web 80. Network region 83 is illustrated as defining hexagons, although it is to be understood that other preselected patterns are useful in this invention.

Figure 9:
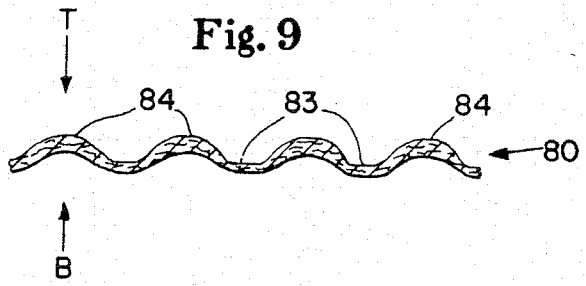
FIG. 9 is a cross sectional view of a portion of the paper web shown in FIG. 8 as taken along line 9—9.

FIG. 9 is a cross-sectional view of paper web 80 taken along line 9—9 of FIG. 8. As can be seen from FIG. 9, network region 83 is essentially monoplanar.

The second region of the improved tissue paper web comprises a plurality of domes dispersed throughout the whole of the network region. In FIGS. 8 and 9 the domes are indicated by reference numeral 84. As can be seen from FIG. 8, the domes are dispersed throughout network region 83 and essentially each is encircled by network region 83. The shape of the domes (in the plane of the paper web) is defined by the network region. FIG. 9 illustrates the reason the second region of the paper web is denominated as a plurality of "domes." Domes 84, appear to extend from (protrude from) the plane formed by network region 83 toward an imaginary observer looking in the direction of arrow T.

When viewed by an imaginary observer looking in the direction indicated by arrow B in FIG. 9, the second region comprises arcuate shaped cavities or dimples. The second region of the paper web has thus been denominated a plurality of "domes" for convenience. The paper structure forming the domes can be intact; it can also be provided with one or more holes or openings extending essentially through the structure of the paper web.

One embodiment of the improved paper has a relatively low network basis weight compared to the basis weights of the domes. That is to say, the weight of fiber in any given area projected onto the plane of the paper web of the network region is less than the weight of fiber in an equivalent projected area taken in the domes. Further, the density (weight per unit volume) of the network region is high relative to the density of the domes.

In a second embodiment, the basis weight of the domes and the network region are essentially equal, but the densities of the two regions differ as indicated above.

In certain embodiments of the improved paper, the average length of the fibers in the domes is smaller than the average length of the fibers in the network region.

Preferred paper webs of this invention have an apparent (or bulk or gross) density of from about 0.025 to about 0.150 grams per cubic centimeter, most preferably from about 0.040 to about 0.100 g/cc. The density of the network region is preferably from about 0.400 to about 0.800 g/cc, most preferably from about 0.500 to about 0.700 g.cc. The average density of the domes is preferably from about 0.040 to about 0.150 g/cc, most preferably from about 0.060 to about 0.100 g/cc. The overall preferred basis weight of the paper web is from about 9 to about 95 grams per square meter. Considering the number of fibers underlying a unit area projected onto the portion of the web under consideration, the ratio of the basis weight of the network region to the average basis weight of the domes is from about 0.8 to about 1.0.

The paper web of this invention can be used in any application where soft, absorbent tissue paper webs are required. One particularly advantageous use of the paper web of this invention is in paper towel products. For example, two paper webs of this invention can be adhesively secured together in face to face relation as taught by U.S. Pat. No. 3,414,459, which issued to Wells on Dec. 3, 1968 and which is incorporated herein by reference, to form 2-ply paper towels.

What is claimed is:

1. A foraminous deflection member comprising a foraminous element and a framework, said framework comprising a macroscopically monoplanar, patterned, continuous network surface defining within said member a plurality of discrete, isolated, deflection conduits.

2. The member of claim 1 wherein said member is at least about 0.35 millimeter thick.

3. The member of claim 2 wherein the perimeter of each of the majority of said deflection conduits defines a polygon having fewer than seven sides and wherein said deflection conduits are distributed in a repeating array.

4. The member of claim 3 wherein said repeating array is a bilaterally staggered array.

5. The member of claim 2 wherein the perimeter of each of the majority of said deflection conduits defines a closed figure having nonlinear sides and wherein said deflection conduits are distributed in a repeating array.

6. The member of claim 5 wherein said repeating array is a bilaterally staggered array.

7. The member of claim 2 wherein said foraminous element is a foraminous woven element.

8. The member of claim 7 wherein said network surface is spaced at least about 0.10 millimeter from the mean upper surface of the knuckles of said foraminous woven element.

9. The member of claim 8 wherein the perimeter of each of the majority of said deflection conduits defines a polygon having fewer than seven sides and wherein said deflection conduits are distributed in a repeating array.

10. The member of claim 9 wherein said repeating array is a bilaterally staggered array.

11. The member of claim 8 wherein the perimeter of each of the majority of said deflection conduits defines a closed figure having nonlinear sides and wherein said deflection conduits are distributed in a repeating array.

12. The member of claim 11 wherein said repeating array is a bilaterally staggered array.

13. The member of claim 8 wherein said framework comprises a solid polymeric material which has been rendered solid by exposing a liquid photosensitive resin to light of an activating wavelength.

14. The member of claim 13 wherein the perimeter of each of the majority of said deflection conduits defines a polygon having fewer than seven sides and wherein said deflection conduits are distributed in a repeating array.

15. The member of claim 14 wherein said repeating array is a bilaterally staggered array.

16. The member of claim 13 wherein the perimeter of each of the majority of said deflection conduits defines a closed figure having nonlinear sides and wherein said deflection conduits are distributed in a repeating array.

17. The member of claim 16 wherein said repeating array is a bilaterally staggered array.

18. The member of claim 13 wherein said framework comprises a second network surface superimposed on said network surface; said second network surface being macroscopically monoplanar, patterned, and continuous; said second network surface and said network surface being mutually coplanar.

19. The member of claim 18 wherein said framework comprises a second network surface superimposed on said network surface; said second network surface being macroscopically monoplanar, patterned, and continuous; said second network surface and said network surface being mutually noncoplanar.

20. The member of claim 13 wherein said framework comprises a second surface superimposed on said network surface, said second surface defining open figures.

21. The member of claim 20 wherein said second surface is macroscopically monoplanar.

22. The member of claim 21 wherein said second surface and said network surface are mutually coplanar.

23. The member of claim 13 wherein said framework comprises a second surface superimposed on said network surface, said second surface defining closed figures.

24. The member of claim 23 wherein said second surface is macroscopically monoplanar.

25. The member of claim 24 wherein said second surface and said network surface are mutually coplanar.

* * * * *